United States Patent [19]

Lander

[11] 4,108,513

[45] Aug. 22, 1978

[54] PAPER DISPENSER, ESPECIALLY TOILET PAPER DISPENSER

[75] Inventor: Lars Bengt Lander, Zug, Switzerland

[73] Assignee: Cepasy AG, Zug, Switzerland

[21] Appl. No.: 782,262

[22] Filed: Mar. 25, 1977

[30] Foreign Application Priority Data

Dec. 17, 1976 [CH] Switzerland ..... 15935/76

[51] Int. Cl.[2] ..... B65H 19/00

[52] U.S. Cl. ..... 312/39; 312/41

[58] Field of Search ..... 312/37, 39, 41; 225/47, 225/53, 77; 221/9, 10, 17, 151, 260, 276

[56] References Cited

U.S. PATENT DOCUMENTS

| | | | |
|---|---|---|---|
| 288,070 | 11/1883 | Lane | 312/41 |
| 316,955 | 5/1885 | Fox | 312/41 |
| 3,865,295 | 2/1975 | Okamura | 312/39 |
| 3,948,454 | 4/1976 | Bastian | 312/39 |

*Primary Examiner*—Casmir A. Nunberg

*Attorney, Agent, or Firm*—Ladas, Parry, Von Gehr, Goldsmith & Deschamps

[57] ABSTRACT

A paper dispenser, especially suitable for dispensing toilet paper, comprising a housing having an outlet opening for a paper web or sheet which is to be withdrawn out of the housing and a tear-off edge for the withdrawn paper web. A paper roll-support is arranged within the housing and serves to carry at least two separate paper rolls. Means enable bringing each of the rolls into a withdrawal position in front of the outlet opening.

6 Claims, 3 Drawing Figures

PAPER DISPENSER, ESPECIALLY TOILET PAPER DISPENSER

BACKGROUND OF THE INVENTION

The present invention relates to a new and improved construction of paper dispenser, and particularly is concerned with a paper dispenser useful for dispensing toilet paper.

Conventional paper dispensers, especially toilet paper dispensers, typically contain only one freely exposed roll of toilet paper which is pushed onto a paper roll-support in the form of a vertically oriented shaft. An extra supply of such paper rolls, if available at all, are then stored someplace in a toilet cabin or other storage area. Experience has shown that sometimes such paper rolls are improperly removed or stolen. Especially in the case of industrial plants or factories, where frequently the toilets are washed down or sprayed with water, it has been found that oftentimes the freely exposed paper rolls are undesirably made soggy by the water.

SUMMARY OF THE INVENTION

Hence, it is a primary object of the present invention to provide a new and improved construction of a paper dispenser which is not associated with the aforementioned drawbacks and limitations of the prior art constructions.

It is another object of the present invention to provide a new and improved construction of paper dispenser, especially for dispensing toilet paper, wherein it is possible to protectively store in a paper roll dispenser a number of toilet rolls, without the danger of the same being easily improperly removed from the dispenser or becoming undesirably wetted or otherwise contaminated.

Yet a further significant object of the present invention aims at the provision of a novel paper dispenser, especially useful for dispensing toilet paper, which is relatively simple in construction and design, economical to manufacture, pleasing in appearance, easy to use, and allows for storage of plural rolls of paper in a manner such that upon depletion of one paper roll it is possible to easily bring into a desired dispensing position a new roll.

Now in order to implement these and still further objects of the invention, which will become more readily apparent as the description proceeds, the paper dispenser of the present invention is manifested by the features that there is provided a housing in which there is arranged a paper roll-support. The housing is provided with an outlet opening for the paper web or sheet withdrawn from the paper roll which is being used, this outlet opening being provided with teeth facilitating tearing-off of a desired length of the withdrawn paper web.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
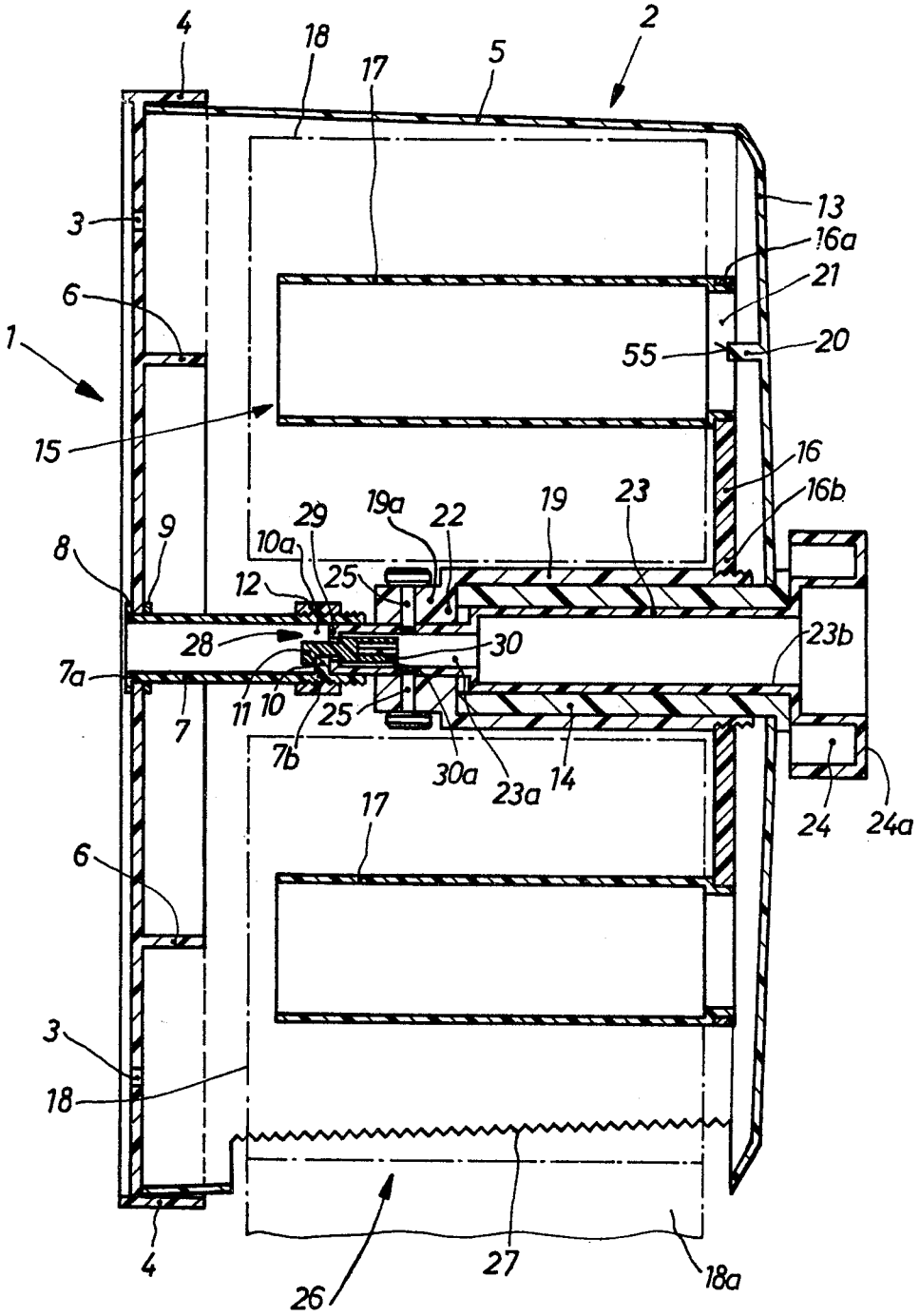
FIG. 1 is a vertical sectional view through a first exemplary embodiment of a paper dispenser constructed according to the teachings of the present invention.
Figure 2:
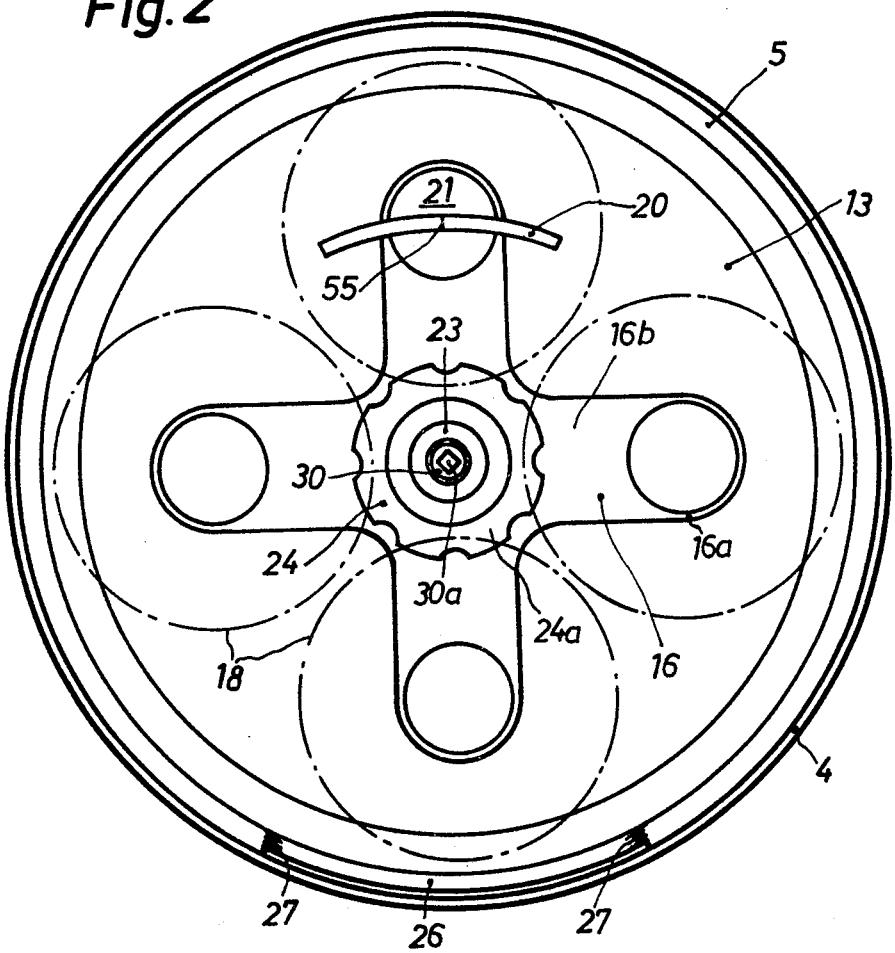
FIG. 2 is a top plan view of the paper dispenser depicted in FIG. 1.

Describing now the drawings, the paper dispenser or similar article illustrated, by way of example, in FIGS. 1 and 2 will be seen to comprise a housing constituted by a plate member or plate 1 and a substantially pot- or dome-shaped cover or cover member 2.

This plate 1 serves for the attachment of the paper dispenser at a wall or other support and thus is provided for instance with continuous holes or openings 3 through which there can be inserted any suitable fastening means, such as attachment screws or bolts which have not been particularly shown. At the edge of the plate 1, which is substantially circular, there is arranged a continuous or circumferential rib 4, the inner surface of which provides an impact surface or stop for the side wall 5 of the substantially pot-shaped cover 2. The plate 1 is also provided with an inner continuous or circumferential rib 6, which likewise serves as a stop or impact surface for the paper roll or rolls 18, as the case may be, which are accommodated in the housing 1, 2, and as will be explained more fully hereinafter. At the center of the substantially circular base plate or plate member 1 there is attached a sleeve 7. The end 7*a* of the sleeve 7 which is attached at the base plate 1 possesses a collar 8 which bears from the outside against the base plate 1, as best seen by referring to FIG. 1. At the inside of the housing 1, 2 there is attached a ring or ring member 9 to the sleeve 7. This ring 9 is fixedly connected both with the sleeve or sleeve member 7 as well as also with the base plate 1. Since these components of the housing 1, 2 are advantageously formed of plastic the interconnection thereof can be accomplished by adhesively bonding these components or by the action of heat. The end 7*b* of the sleeve 7 which is located within the housing 1, 2 is provided with a floor portion or base 10 in which there is formed an opening 10*a* for receiving a substantially hook-shaped element 11 of the pot-shaped cover 2. This end 7*b* of the sleeve 7 is additionally provided with a cylinder or cylindrical member 12 which serves to reinforce this sleeve end 7*b*.

The substantially pot- or dome-shaped cover 2 possesses a floor or base portion 13 which merges with the side wall 5 and can be either flat, or as shown in FIG. 1, slightly conical in shape. At the center of the floor portion 13 of the cover 2 there is attached a hollow pin or plug 14 upon which there is rotatably mounted a paper roll support or carrier 15. The paper roll support 15 will be seen to be equipped with a number of radially extending arms 16, each free end 16*a* of which carries an associated mandrel 17 upon which there is mounted the related paper roll 18. The inboard end 16*b* of each of the arms 16 is secured to a bearing sleeve 19 which is mounted upon the hollow pin 14, so that the entire paper roll support or support means 15 together with the paper rolls 18 can be conveniently rotated about the pin or pin member 14. In order to be able to arrest the roll support or support means 15 in a predetermined position, during withdrawal of the paper web or sheet from one of the paper rolls 18, for instance as indicated by the portion of the paper web 18*a* at the bottom end of FIG. 1, there is provided a projection 20 constructed to possess gradually ascending side walls, and the apex portion 55 of which engages into the opening 21 formed at the associated arm end 16*a*, and thereby arrests the momentary position of the entire roll support or support means 15.

The front part 19*a* of the bearing sleeve 19 possesses a shoulder or stepped portion 22 structured to receive one end 23*a* of a hollow shaft 23 mounted within the pin 14. The other end 23*b* of the hollow shaft 23 carries an actuation element 24 for the paper roll support 15, which actuation element may be constituted for instance by a rotatable knob 24*a* or equivalent structure. The bearing sleeve 19 and the shaft 23 are secured against relative rotational movement by means of the pins 25 which piercingly extend through both of these components, as best seen by referring to FIG. 1.

At the lower region of the substantially pot-shaped cover 2 there is provided an outlet opening 26 for the paper web or sheet 18*a* which is to be used, this paper web-outlet opening 26 being provided with teeth or other suitable serrations 27 facilitating tearing-off of the required length of such paper web.

In the event that the paper roll 18 which is located closest to the outlet opening 26 is empty, then it is only necessary to rotate the entire paper roll support 15, with the aid of the rotatable knob 24*a*, through 90° or more in one of the two possible directions of rotation, until a new paper roll 18 is located in front of the paper roll-outlet opening 26. This outlet opening 26 can possess a width which is almost as large as a paper roll, so that the end of the paper web or sheet 18*a* can be easily detached from the related roll 18.

Continuing, the substantially hook-shaped element 11 is a component of a connection element or mechanism 28 which possesses a circular shank 30 which is supported at a transverse wall 29 in the hollow shaft 23. This shank 30 is provided with a blindhole bore 30*a* of substantially square cross-section into which there can be inserted a not particularly illustrated suitable tool or other appropriate implement. Upon insertion of the tool into the connection mechanism or element 28 and by rotating the latter, it is possible to selectively interrupt or establish the connection between the plate 1 and the cover 2.

This cover 2 and also the components of the paper dispenser which are arranged therein can be formed of any suitable plastic. The cover proper, consisting of the floor or base portion 13 and the side wall or walls 5, advantageously can be constructed to be transparent, so that it is possible to visually determine the location of a new paper roll 18 at the paper roll support 15. Furthermore, it is desirable, particularly for the purpose of improving the appearance of the paper dispenser to construct the cover 2 to be transparent, but formed of a colored plastic.

Figure 3:
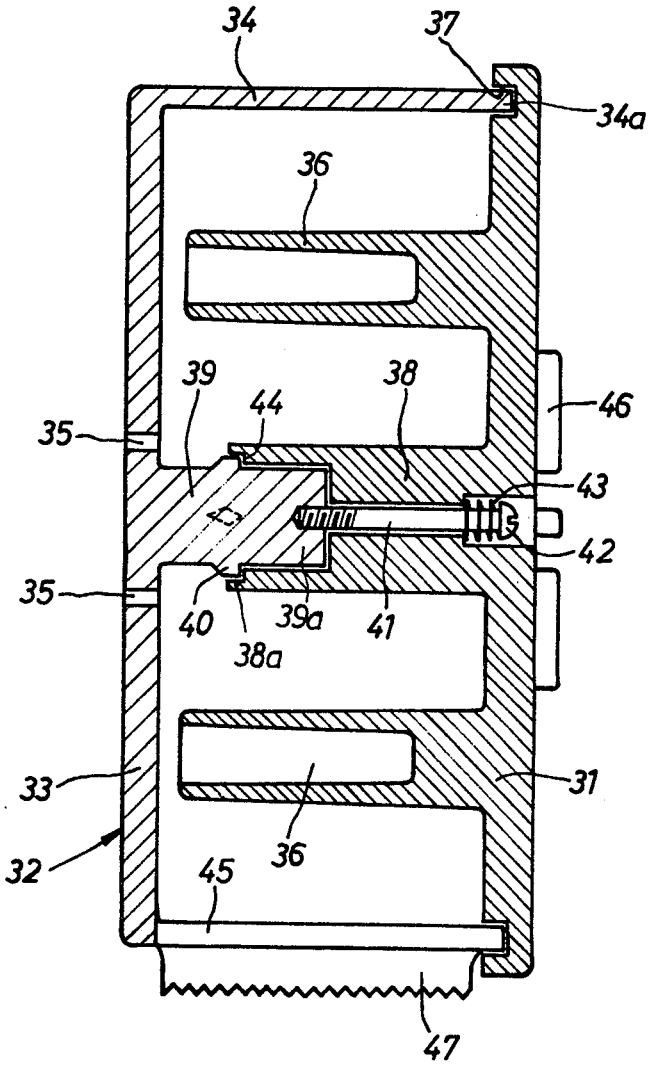
FIG. 3 is a longitudinal sectional view of a second exemplary embodiment of paper dispenser constructed according to the invention.

At this point there will be considered the modified construction of paper dispenser as shown in FIG. 3. Again the same will be seen to comprise a housing consisting of a plate or plate member 31 and a substantially pot-shaped cover or cover member 32. This pot-shaped or dome-shaped cover 32 includes a floor or base portion 33 and a substantially cylindrical-shaped wall 34 upon which there is mounted the plate 31. The floor 33 of the cover 32 can be secured for instance at a vertical wall or other supporting surface by means of screws, bolts or any other appropriate fastening devices which are inserted through the holes or openings 35. Roll supports or support means 36, located in spaced relationship from one another at the base plate 31 at an angle of approximately 90° are provided for supporting the individual paper rolls 18. The showing of FIG. 3 only illustrates, as a matter of convenience, the upper and lower roll supports 36 of the roll support structure. The base plate 31 is mounted to be rotatable about the axis of the cover wall 34, and the marginal portion or edge 34*a* of this cover wall 34 rests in a groove 37 provided at the plate or plate member 31. The inner surface of the plate 31 is equipped with a substantially centrally arranged sleeve 38 which engages about the free end 39*a* of a pin or plug 39 arranged substantially centrally at the cover floor or base 33. The sleeve 38 is supported at the protuberances or projections 40 laterally extending from the pin 39. A screw 41 or equivalent expendient piercingly extends through the sleeve 38 and is threaded into the pin or plug member 39. Between the head 42 of the screw 41 and the plate 31 there is arranged a spring 43 or the like. The end 38*a* of the sleeve 38 possesses recesses or depressions 44 which can extend through the wall of the sleeve. In the illustrated embodiment these recesses or depressions 44 do not extend completely through the sleeve wall. When the paper dispenser is mounted in a position ready for operation i.e. for dispensing paper from a paper roll 18, the projections 40 extend into the recesses 44, so that the sleeve or sleeve member 38 is arrested in a predetermined position when one of the paper rolls 18 is located at the region of the paper roll-outlet opening 45 formed in the cylinder wall 34.

At the outside of the plate 31 there are formed elongate projections or ribs 46 which render possible the convenient rotation of the plate 31 at the fixed cover 32. During such rotation the plate 31 is slightly raised, because the projections or protuberances 40 move out of the recesses 44, and after for instance one-quarter rotation the plate 31 is again releasibly lockingly engaged. Hence, the next paper roll 18 has been moved into a position ready for use.

With suitable construction of the screw head 42 it is possible to ensure that the screw 41 can only be threaded-out of the pin 39 with the aid of a special tool or key, so that only authorized individuals can remove the plate 31 for the purpose of refilling the paper dispenser.

The four paper rolls 18 are covered by the paper dispenser i.e. the housing 31, 32 thereof, with the exception of the outlet or dispensing opening 45 which is equipped with the tear-off edge 47 for tearing-off a predetermined length of the paper web, as previously explained, wherefor the contents of the paper dispenser are effectively prevented from becoming undesirably wet or exposed to other adverse effects.

It is most advantageous to construct the plate 31, the roll support or support means 36 for supporting the paper rolls, the sleeve 38 and the ribs 46 from one plastic piece. Also the cover 32 together with the plug 39 can be advantageously formed of one-piece.

While there are shown and described present preferred embodiments of the invention, it is to be distinctly understood that the invention is not limited thereto, but may be otherwise variously embodied and practiced within the scope of the following claims. Accordingly,

What is claimed is:

1. A paper dispenser for dispensing a web of paper from a paper roll, comprising:

a housing for accommodating therein a plurality of paper rolls;

said housing being provided with an outlet opening for dispensing a paper web withdrawn from its associated roll;

means defining a tear-off edge provided for the housing at the region of the outlet opening for tearing-off a desired length of the paper web to be withdrawn out of the housing;

paper roll-support means arranged in said housing for supporting at least two separate paper rolls; and means for selectively placing each of the paper rolls into a withdrawal position in front of said outlet opening.

2. The paper dispenser as defined in claim 1, wherein:

said housing comprises a substantially pot-shaped cover and a plate connectable with said cover;

said substantially pot-shaped cover including side wall means, said paper roll-support means being arranged at the inside of said cover;

said side wall means of said cover being provided with said outlet opening for the withdrawn paper web;

said plate including means for fixing the paper dispenser;

said paper roll-support means comprises at least two interconnected arms, each of said arms having a free end;

a mandrel for supporting a paper roll carried at the free end of each said arm;

a hollow pin;

said arms being rotatably mounted on said hollow pin; and said selectively placing means comprising actuation means cooperating with said arms and arranged at the outside of said substantially pot-shaped cover.

3. The paper dispenser as defined in claim 2, further including:

said pin being mounted at said cover;

said sleeve extending towards said pin;

said sleeve having a floor provided with an opening;

a substantially hook-shaped element engaging into said opening of said sleeve;

said hook-shaped element having an end thereof mounted in said hollow pin and actuatable by means of a tool.

4. A paper dispenser for dispensing a web of paper from a paper roll, comprising paper roll-support means for supporting at least two separate paper rolls and a housing having said paper roll-support means disposed therein, said housing comprising a base plate which is integrally formed with said paper roll-support means, and a substantially pot-shaped cover which is formed with an outlet opening for dispensing a paper web withdrawn from its associated roll and with means defining a tear-off edge in the region of the outlet opening for tearing-off a desired length of the paper web to be withdrawn out of the housing, and is also formed with means for fixing the paper dispenser, the paper dispenser further comprising means securing the base plate to the cover so that the base plate is rotatable with respect to the cover, whereby each of the paper rolls supported by the paper roll-support means may be placed in a withdrawal position in front of said outlet opening.

5. The paper dispenser as defined in claim 4, wherein said base plate has a substantially circular configuration and is formed with a substantially ring-shaped groove, and said substantially pot-shaped cover has side wall means which engage into the ring-shaped groove thereby to rotatably arrange said plate at said cover.

6. The paper dispenser as defined in claim 4, wherein said base plate is formed with a substantially centrally arranged sleeve provided with recess means at one end thereof, and said cover includes a floor having a pin substantially centrally mounted thereat and having laterally extending projections, said sleeve being resiliently held against the laterally extending projections of said pin in such a manner that said projections are located in said recess means of said sleeve and together therewith form locking locations.

* * * * *